US005202089A

United States Patent [19]

Norström et al.

[11] Patent Number: 5,202,089

[45] Date of Patent: Apr. 13, 1993

[54] PRECIPITATION-HARDENABLE TOOL STEEL

[75] Inventors: Lars-Åke Norström; Henrik Jespersson, both of Hagfors, Sweden

[73] Assignee: Uddeholm Tooling Aktiebolag, Hagfors, Sweden

[21] Appl. No.: 700,962

[22] Filed: May 16, 1991

[51] Int. Cl.[5] ..... C22C 38/06; C22C 38/40

[52] U.S. Cl. ..... 420/63; 148/318; 148/326; 148/327

[58] Field of Search ..... 148/318, 326, 327; 420/43, 62, 63

[56] References Cited

FOREIGN PATENT DOCUMENTS 31800 7/1981 European Pat. Off. ..... 148/327

2453109 5/1975 Fed. Rep. of Germany ..... 148/326

*Primary Examiner*—Deborah Yee

*Attorney, Agent, or Firm*—Nikaido, Marmelstein, Murray & Oram

[57] ABSTRACT

The invention relates to a precipitation-hardenable tool steel intended for plastic forming tools manufactured therefrom. The tool steel at the manufacturing of the tool and prior to hardening through ageing treatment but after solution heat treatment and cooling to room temperature has a hardness less than 40 HRC, but after the manufacturing of the tool and the subsequent age hardening treatment, i.e. in the precipitation hardened condition, is harder than 45 HRC and has a high corrosion resistance and a toughness sufficient for plastic forming tools. The steel contains in weight-%:

| | | |
|---|---|---|
| max | 0.08 | C, |
| max | 1 | Si, |
| max | 2 | Mn, |
| | 9–13 | Cr, |
| | 7–11 | Ni, |
| max | 1 | Mo, |
| | 1.4–2.2 | Al, and |

balance being essentially only iron, impurities and accessory elements in normal amounts.

14 Claims, No Drawings

PRECIPITATION-HARDENABLE TOOL STEEL

TECHNICAL FIELD

This invention relates a precipitation-hardenable tool steel intended for plastic forming tools manufactured therefrom. The tool steel at the manufacturing of the tool and prior to hardening through ageing treatment but after solution heat treatment and cooling to room temperature, has a hardness of less than 40 HRC, but after the manufacturing of the tool and the subsequent age-hardening treatment, i.e. in the precipitation-hardened condition, is harder than 45 HRC. The steel also has a high corrosion resistance and a toughness sufficient for plastic forming tools.

BACKGROUND OF THE INVENTION

Tools (moulds) made from tool steel are used for the forming of plastic articles, e.g. for injection moulding and compression moulding. These tools often are very large and, at the same time, they may have a very complicated design.

During the plastic forming operation, the tools are subjected to high stress: in the first place mechanical stress but also in the form of chemical attacks. This can cause different types of damages of the tools, above all of the following nature:

abrasion,
plastic deformation (impressions),
rupture (fatigue), and
corrosion.

The features of the tool steel have significant importance for the resistance of the tools against these types of damages. In principle a perfect tool steel shall be hard, tough and corrosion resistant in order to produce plastic forming tools which have a high capacity and at the same time a good reliability.

Another important thing is that complicated tools shall be able to be manufactured in a reasonably simple manner, e.g. through cutting operations. This implies that the tool steel if possible should satisfy the following conditions:

It shall be soft (<40 HRC) when the tool is being manufactured, i.e. in the starting condition.

It shall be possible to make the steel hard (>45 HRC) by means of a simple heat treatment of the finished tool without any changes of the shape or of the dimensions of the tool which would require complicated adjustments.

If all these aspects are considered, the following combination of the desired features may be listed for the perfect tool steel for plastic forming:

1—Hardness<40 HRC in the starting condition.
2—Hardness>45 HRC, preferably about 50 HRC, shall be achieved through a simple heat treatment.
3—It shall be possible to provide an even hardness also in the case of very large dimensions (large size tools).
4—The increase of the hardness shall be achieved without any complicating changes of shape or volume.
5—The steel shall have a high corrosion resistance, i.e. be of the stainless type.
6—The steel shall have a sufficient toughness.
7—The steel shall be able to be afforded an extra good wear resistance through e.g. any simple surface treatment.

Since a good corrosion resistance is a primary requirement, a steel of this type has to be found within the category of steels which includes stainless steels, i.e. steels having a chromium content>10%. There exist today a large number of more or less commercially established stainless steels. A thorough technical evaluation of the steel types which already exist can be summed up in the following way as far as the desired features are concerned (1–7 above):

Austenitic, ferritic, and ferritic-austenitic stainless steel grades do not have qualifications to fulfill the requirement as far as hardness is concerned (2), not even precipitation-hardenable variants.

Martensitic stainless steels based on carbon martensite, so called 13% chromium steels etc., have better conditions to provide the desired combination of features. Due to the fact that they have to be hardened and tempered in order to fulfill the requirements as far as hardnesses are concerned (1 and 2) they will, however, not satisfy the requirement as far as the shape and size stability (4) is concerned. Besides, these steel usually have a weak corrosion resistance.

Precipitation-hardenable stainless steels based on low carbon martensite, so called PH-steels, generally have the best conditions to fulfill the desired combination of features. There exist at least about twenty variants of these types of steel today. Generally it is a question of minor modifications of the three main types 17-4 PH, 17-7 PH, and 15-5 PH where the first number indicates the chromium content and the second number indicates the nickel content. Usually copper or aluminum is used as a precipitation hardening alloy additive. Generally these steels have good corrosion resistance. A review of established PH-steels, however, indicates that as a matter of fact there today does not exist any steel grade which can fulfill all the above mentioned requirements. A common disadvantage of these steels is that they usually cannot provide a sufficient precipitation-hardening effect, i.e. they cannot satisfy the important hardness condition (2).

The situation prior to the present invention thus was that there was no suitable steel available which could satisfy all the desired features.

BRIEF DESCRIPTION OF THE INVENTION

An objective of the invention is to provide a new, specially composed stainless precipitation-hardenable steel, based on low carbon martensite, which steel shall be able to satisfy all the conditions (1–7) which have been mentioned above.

In order to satisfy the demands (1–4 above) as far as the hardness is concerned, the steel should have the following characteristic features:

An austenitic matrix at high temperatures (>900° C.).

A low content of primary ferrite (δ-ferrite) i.e. not more than 5% and preferably no measurable amounts of primary ferrite.

A very high hardenability, i.e. ability to form martensite, even when the article has very large dimensions, by cooling from high temperatures.

A sufficiently low hardness of the obtained martensite in the untempered condition (<40 HRC).

An ability to achieve sufficient hardness (>45 HRC) by a simple heat treatment of the untempered martensite, e.g. by ageing treatment at a fairly low temperature.

A suitable content of rest austenite, preferably 5–20%, in the aged condition in order to provide sufficient toughness.

A too high content of ferrite causes uneven hardness, particularly when the steel tool has large dimensions, as well as problems in the hot working (forging, rolling) of the steel, while a too high content of rest austenite causes a too low hardness, and a too low content of rest austenite will give the steel an unsufficient toughness.

In order to achieve all the above mentioned desired features in combination with good resistance to corrosion it is necessary to provide a complicated interaction between several critical alloying elements and a strong optimization of their contents in the steel composition. The main problem is to provide this optimization, which however, has successfully been achieved through the following composition: max 0.08 C, max 1 Si, max 2 Mn, 9–13 Cr, 7–11 Ni, max 1 Mo, 1.4–2.2 Al, and balance essentially only iron, impurities and accessory elements in normal amounts.

As the different alloying elements in the steel interact with each other in manner which may be defined as synergistic it is difficult to value the importance of every single element. Nevertheless an attempt to make such analysis is made in the following.

Carbon

The carbon content has significant importance for the hardenability of the steel in the starting condition, i.e. for the hardness of the untempered martensite which is obtained by cooling from hot working temperature to room temperature. This hardness is strongly increased by increasing the carbon content. For this reason the carbon content has to be kept low and must not exceed 0.08%, preferably not exceed 0.06%. For metallurgical reasons relating to the manufacturing of the steel, however, a certain amount of carbon should exist in the steel and also in order that the steel shall not be to soft. Therefore the steel should contain at least 0.01% carbon. Carbon also counteracts the formation of ferrite, which is favourable. An optimal content of carbon is 0.02–0.06%.

Silicon

This element has no significant importance to the invention but may be added as a desoxidizing agent to the molten steel in a manner which is conventional in stainless steel making practice. However, silicon is a strong ferrite stabilizer. The content of silicon should therefore be limited to not more than about 1%.

Manganese

Manganese is another element which has no significant importance in this steel. It is true that manganese like nickel is an austenite stabilizer but its effect is not as strong as that of nickel. Manganese further lowers the —$M_s$ and $M_f$—temperatures more than nickel does which is unfavourable. The role of manganese in the steel is therefore limited to its use as a desulphurizer by forming manganese sulphide in a manner know per se. If however, the alloy is intentionally alloyed with sulphur, which is conventional for improving the cuttability of steel, an increased content of manganese may be considered. The steel according to the invention therefore may contain from traces up to 2% Mn.

Chromium

The most important purposes of chromium in the steel are to give the steel a good corrosion resistance and a good hardenability. In order to give the steel a sufficient corrosion resistance there is needed at least 9% chromium, preferably at least 10% chromium, which at the same time gives a basis for a high hardenability. Chromium as an alloying element in steel, however, is ferrite stabilizing at high temperatures and it also moves the transformation of austenite to martensite against lower temperatures (reduces $M_s$ and $M_f$). This implies that chromium has a tendency to increase δ-ferrite as well as rest austenite in an unfavourable manner. For these reasons the chromium content must be limited to max 13%. An optimal range of the chromium content is 11–12%.

Nickel

Nickel is a multi-purpose element in the steel. Like chromium, nickel increases the hardenability and improves the corrosion resistance. Further, the toughness of the martensite is increased by addition of this element. What makes the use of nickel necessary according to the invention, however, is on one hand its austenite stabilizing effect, which reduces the amount of δ-ferrite in the steel, and on the other hand that nickel in combination with aluminum is responsible for the precipitation-hardening. This sets the lower limit for the nickel content. Like chromium, however, nickel also reduces $M_s$ and $M_f$ which causes an increased content of rest austenite. This sets the upper limit for a conceivable nickel content. The effect of nickel upon the existence of δ-ferrite and rest austenite, respectively, is shown in table 2 (compare steels 1–4 and 6–7, respectively). The useful region of the nickel content according to the invention therefore is as narrow as 7–11%, preferably 8–10%, more preferably 8.5–9.5%.

Molybdenum

Molybdenum like silicon is a comparatively strong ferrite stabilizer, which limits the content of this element to max 1%. Smaller additions of molybdenum, however, are favourably i.a. for counteracting the destruction (recovery) of the martensitic structure during ageing treatment. The steel according to the invention therefore preferably may contain 0.1–0.6% molybdenum.

Aluminum

This element in combination with nickel can form an intermetallic phase (NiAl). This phase has a high solubility in austenite but can give finely dispersed precipitations causing strong precipitation-hardening effects (increase of hardness) in martensite and ferrite by ageing treatment. This makes aluminum a key element in the invention, which sets a lower limit for the content of aluminum to at least 1.4%, preferably at least 1.6% Al. Aluminum, however, is strongly ferrite stabilizing and it therefore may easily increase the risk for undesired amounts of δ-ferrite in the steel. This strongly limits the content of aluminum. The steel therefore should not contain more than max 2.2% Al, preferably max 2.0% Al.

Nitrogen

The steel must not contain nitrogen in amounts more than what is unavoidably dissolved in the steel during its manufacturing, since nitrogen may form hard nitrides which impair the polishability of the steel, which is unfavourable, as the steel shall be used for the manufacturing of plastic forming tools.

Niobium, Titanium, Tantalum, Zirconium

A stabilizing of the steel by means of strong carbide and nitride formers, like niobium, titanium, tantalum, and zirconium, would give rise to very hard carbide and nitride particles. Such particles are unfavourable for the intended use of the steel as plastic forming tools, which shall be able to be polished to a high surface finish. The steel therefore must not contain more than unavoidable traces of niobium, titanium, tantalum, or zirconium.

Sulphur

Sulphur possibly may be included in the steel composition in order to improve the cuttability of the steel in a manner known per se. The content of sulphur, however, should not exceed 0.1%.

Copper

From an economical point of view it is important that the steel does not contain any elements which would make it difficult to reuse as return scrap. Copper is an element which from this reason is not desired in the steel. As a matter of fact it is a purpose of the invention to provide the features (1–7) mentioned in the preamble without any additions of copper to the steel. In spite of the fact that it is very well known that copper may have a favourable inpact upon the precipitation-hardenability it is therefore a characteristic feature of the invention that the steel does not contain copper more than as an unavoidable impurity.

EXPERIMENTS AND RESULTS

The composition of the steels which have been examined are listed in table 1. Besides the alloying elements mentioned in the table the steels only contained iron and impurities and accessory elements in normal amounts. The alloys were manufactured in the form of 50 kg laboratory melts which were casted to 50 kg ingots. The ingots were hot forged from about 1200° C. to flat bars having a cross section 125×40 mm. The bars thereafter were cooled freely in air to room temperature.

TABLE 1

Chemical composition (weight-%) of examined steel alloys

| Steel | C | Si | Mn | Cr | Ni | Mo | Al | Cu |
|---|---|---|---|---|---|---|---|---|
| 1 | 0.054 | 0.41 | 0.33 | 11.5 | 7.3 | 0.51 | 2.13 | — |
| 2 | 0.052 | 0.33 | 0.31 | 11.5 | 8.3 | 0.32 | 2.10 | — |
| 3 | 0.053 | 0.31 | 0.30 | 11.5 | 9.3 | 0.32 | 2.06 | — |
| 4 | 0.051 | 0.28 | 0.28 | 11.4 | 10.4 | 0.31 | 2.04 | — |
| 5 | 0.060 | 0.43 | 0.34 | 11.6 | 9.2 | 0.32 | 1.77 | — |
| 6 | 0.024 | 0.38 | 1.03 | 11.4 | 9.3 | 0.26 | 2.00 | — |
| 7 | 0.025 | 0.39 | 0.37 | 11.5 | 11.4 | 0.26 | 2.10 | — |
| 8 | 0.053 | 0.37 | 0.35 | 11.2 | 6.3 | 0.54 | 1.50 | 2.91 |
| 9 | 0.025 | 0.39 | 1.08 | 11.8 | 8.3 | 0.26 | 1.80 | 3.01 |
| 10 | 0.052 | 0.37 | 0.32 | 9.7 | 7.2 | 0.50 | 2.20 | — |
| 11 | 0.038 | 0.30 | 0.32 | 11.2 | 9.3 | 0.30 | 1.40 | — |

The hardness of the steel alloys was measured in the starting condition (forged and air cooled to room temperature) and then in the ageing treated condition (500°–525° C./2 h, followed by air cooling to room temperature). Further the amounts of ferrite and rest austenite in the alloys after ageing treatment were measured. The measured values are shown in table 2.

TABLE 2

Hardnesses and the content of ferrite and rest austenite of the examined steel alloys

| Steel | Hardness (U) HRC | Hardness (A) HRC | Ferrite (U) % | Rest austenite (U) % |
|---|---|---|---|---|
| 1 | 37 | 49 | 14 | 1 |
| 2 | 37 | 51 | 3 | 3 |
| 3 | 36 | 51 | 2 | 12 |
| 4 | 30 | 43 | >0.5 | 25 |

TABLE 2-continued

Hardnesses and the content of ferrite and rest austenite of the examined steel alloys

| Steel | Hardness (U) HRC | Hardness (A) HRC | Ferrite (U) % | Rest austenite (U) % |
|---|---|---|---|---|
| 5 | 34 | 46 | 0.5 | 17 |
| 6 | 30 | 50 | >0.5 | 12 |
| 7 | 28 | 40 | >0.5 | 30 |
| 8 | 39 | 51 | 1 | 4 |
| 9 | 31 | 50 | >0.5 | 18 |
| 10 | 37 | 50 | 8 | 3 |
| 11 | 35 | 47 | >0.5 | 15 |

U = Starting condition
A = ageing treated condition

From table 2 is apparent that steels having a composition according to the invention can satisfy the demands (1–3 above) as far as the hardness is concerned. In order to examine if also other demands (4–7 above) can be satisfied, measurements were performed of the change of volume in connection with the ageing treatment, corrosion testing, toughness testing, and nitrogen experiment, essentially with steels Nos. 2 and 3 in table 1. The results are summed up in the following way:

Ageing treatment brings about a uniform shrinking in all directions of <0.10% (typically 0.05%). This implies that the steel has an extremely good dimension stability as compared to conventional tool steels subjected to hardening and tempering.

Corrosion tests in salt-fog-chambers and corrosions tests of the type registering polarization graphs indicated that steels according to the invention have a surprisingly good corrosion resistance, even better than e.g. grade 17-4 PH which contains 17% chromium. This surprisingly high corrosion resistance is likely to be due to a favourable synergetic effect of the unique combination of the contents of Cr, Ni and Al, which is characteristic in for the present invention.

Impact strength tests were performed subsequent to ageing treatments to various hardnesses in the range 38–51 HRC. The impact strength dropped with increased harness level in a manner which is normal for steel. The toughness level was at level with what is normal for e.g. tough hardening steels and is quite sufficient for the use for plastic forming tools.

Gas nitriding, which is a simple and established surface treatment method, was examined. The results indicate that steels according to the invention have very good nitridability, and that extremely hard (1400 HV) and wear resistant nitriding layers may be achieved. The reason for this unique feature of a stainless steel is the high content of aluminum, which as a matter of fact makes steel according to the invention stainless "nitriding steels".

What is interesting with using nitriding as a method of increasing the wear resistance of the steel according to the invention is that the ageing treatment and the nitriding can be performed as a single procedure which implies substantial simplification in many applications.

In the optimization of the composition of the steel, which is expressed in the indicated contents in the appending claims, it has been considered that the experiments have been made in the form of comparatively small laboratory charges. For the production in full scale one has to realize that larger dimensions will give a lower precipitation-hardening effect, i.e. a somewhat lower hardness after ageing treatment than what is stated in table 2. For example, steel No. 11 in tables 1–2 should not satisfy the demand as far as hardness is concerned (>45 HRC) if the steel article has large dimensions.

We claim:

1. Precipitation-hardenable tool steel suitable for manufacturing plastic forming tools therefrom, the said tool steel at the manufacturing of the tool and prior to hardening through ageing treatment but after solution heat treatment and cooling to room temperature having a hardness less than 40 HRC, but after the manufacturing of the tool and the subsequent age hardening treatment being harder than 45 HRC and having a high corrosion resistance and a toughness sufficient for plastic forming tools, wherein the steel contains in weight-%

| | | |
|---|---|---|
| max | 0.08 | C, |
| max | 1 | Si, |
| max | 2 | Mn, |
| | 9–13 | Cr, |
| | 7–11 | Ni, |
| max | 1 | Mo, |
| | 1.4–2.2 | Al, and |

balance being essentially only iron, impurities and accessory elements in normal amounts, which steel does not contain carbon and nitrogen stabilizing elements selected from the group consisting of Nb, Ti, Ta and Zr in amounts more than as unavoidable impurities.

2. Steel according to claim 1, which contains 0.01–0.07 C.

3. Steel according to claim 1, which contains at least 10 Cr.

4. Steel according to claim 1, which contains 11–12 Cr.

5. Steel according to claim 1, which contains 8–10 Ni.

6. Steel according to claim 5, which contains 8.5–9.5 Ni.

7. Steel according to claim 1, which contains 0.1–0.6 Mo.

8. Steel according to claim 1, which contains 1.6–2.0 Al.

9. Steel according to claim 1, which contains sulphur in an amount of max 0.1% in order to improve the cuttability of steel.

10. Steel according to claim 1, which has a substantially martensitic structure containing 5–20% rest austenite and not more than 5% ferrite after precipitation treatment through ageing at a temperature of 475°–550° C. for at least 30 min and not more than 4 h.

11. A plastic forming tool made of precipitation-hardened tool steel, said tool steel at the manufacturing of the tool and prior to hardening through aging treatment but after solution heat treatment and cooling to room temperature having a hardness less than 40 HRC, but after the manufacturing of the tool and the subsequent age hardening treatment, being harder than 45 HRC and having a high corrosion resistance and a toughness sufficient for plastic forming tools, wherein the steel contains in weight-%

| | | |
|---|---|---|
| max | 0.08 | C, |
| max | 1 | Si, |
| max | 2 | Mn, |
| | 9–13 | Cr, |
| | 7–11 | Ni, |
| max | 1 | Mo, |
| | 1.4–2.2 | Al, and |

balance being essentially only iron, impurities and accessory elements in normal amounts, which tool steel does not contain carbon and nitrogen stabilizing elements selected from the group consisting of Nb, Ti, Ta and Zr in amounts more than as unavoidable impurities.

12. A plastic forming tool made of precipitation-hardened tool steel, said tool steel at the manufacturing of the tool and prior to hardening through aging treatment but after solution heat treatment and cooling to room temperature having a hardness less than 40 HRC, but after the manufacturing of the tool and the subsequent age hardening treatment, being harder than 45 HRC and having a high corrosion resistance and a toughness sufficient for plastic forming tools, wherein the steel contains in weight-%

| | | |
|---|---|---|
| max | 0.08 | C, |
| max | 1 | Si, |
| max | 2 | Mn, |
| | 9–13 | Cr, |
| | 7–11 | Ni, |
| max | 1 | Mo, |
| | 1.4–2.2 | Al, and |

balance being essentially only iron, impurities and accessory elements in normal amounts, which tool has a hard and wear-resistant nitriding surface layer thereon.

13. A plastic forming tool made of precipitation-hardened tool steel, the said tool steel at the manufacturing of the tool and prior to hardening through aging treatment but after solution heat treatment and cooling to room temperature having a hardness less than 40 HRC, but after the manufacturing of the tool and the subsequent age hardening treatment, being harder than 45 HRC and having a high corrosion resistance and a toughness sufficient for plastic forming tools, said steel having a substantially martensitic structure containing 5–20% rest austenite and not more than 5% ferrite after precipitation treatment through aging at a temperature of 475°–550° C. for at least 30 minutes and not more than 4 hours, wherein the steel contains in weight-%:

| | | |
|---|---|---|
| max | 0.08 | C, |
| max | 1 | Si, |
| max | 2 | Mn, |
| | 9–13 | Cr, |
| | 7–11 | Ni, |
| max | 1 | Mo, |
| | 1.4–2.2 | Al, and |

balance being essentially only iron, impurities and accessory elements in normal amounts, and which tool has a hard and wear-resistant nitriding surface layer thereon.

14. A plastic forming tool made of precipitation-hardened tool steel, the said tool steel at the manufacturing of the tool and prior to hardening through aging treatment but after solution heat treatment and cooling to room temperature having a hardness less than 40 HRC, but after the manufacturing of the tool and the subsequent age hardening treatment, being harder than 45 HRC and having a high corrosion resistance and a toughness sufficient for plastic forming tools, said steel having a substantially martensitic structure containing 5–20% rest austenite and not more than 5% ferrite after precipitation treatment through aging at a temperature of 475°–550° C. for at least 30 minutes and not more than 4 hours, wherein the steel contains in weight-%:

| | | |
|---|---|---|
| max | 0.08 | C, |
| max | 1 | Si, |
| max | 2 | Mn, |
| | 9–13 | Cr, |
| | 7–11 | Ni, |
| max | 1 | Mo, |

-continued

| | |
|---|---|
| 1.4–2.2 | Al, and |

balance being essentially only iron, impurities and accessory elements in normal amounts, which tool steel does not contain carbon and nitrogen stabilizing elements selected from the group consisting of Nb, Ti, Ta and Zr in amounts more than as unavoidable impurities.

* * * * *

UNITED STATES PATENT AND TRADEMARK OFFICE

CERTIFICATE OF CORRECTION

PATENT NO. : 5,202,089

DATED : April 13, 1993

INVENTOR(S) : NORSTROM et al

It is certified that error appears in the above-identified patent and that said Letters Patent is hereby corrected as shown below:

On the cover page, please add --item [30], foreign application priority data, Swedish Appln. No. 9001917-5, May 29, 1990--.

Signed and Sealed this

Eleventh Day of January, 1994

Bruce Lehman

*Attest:*

BRUCE LEHMAN

*Attesting Officer*

*Commissioner of Patents and Trademarks*